US010575379B1

(12) United States Patent
Pishdadian, Jr. et al.

(10) Patent No.: US 10,575,379 B1
(45) Date of Patent: Feb. 25, 2020

(54) SYSTEM AND METHOD OF TWO-WIRE CONTROL OF MULTIPLE LUMINARIES

(71) Applicants: Hamid Pishdadian, Jr., Warick, RI (US); Thomas A. Spinelli, Staten Island, NY (US); Akram A. Khalis, Staten Island, NY (US)

(72) Inventors: Hamid Pishdadian, Jr., Warick, RI (US); Thomas A. Spinelli, Staten Island, NY (US); Akram A. Khalis, Staten Island, NY (US)

(73) Assignee: North American Manufacturing Enterprises, Inc.

( * ) Notice: Subject to any disclaimer, the term of this patent is extended or adjusted under 35 U.S.C. 154(b) by 0 days.

(21) Appl. No.: 16/103,544

(22) Filed: Aug. 14, 2018

(51) Int. Cl.
*H05B 33/08* (2006.01)

(52) U.S. Cl.
CPC ..... *H05B 33/0827* (2013.01); *H05B 33/0845* (2013.01); *H05B 33/0857* (2013.01)

(58) Field of Classification Search
None
See application file for complete search history.

(56) References Cited

U.S. PATENT DOCUMENTS

2007/0024213 A1* 2/2007 Shteynberg ..... H05B 33/0815 315/291
2011/0069960 A1* 3/2011 Knapp ..... H04L 12/43 398/103
2011/0260535 A1* 10/2011 Wanner ..... H02M 3/1588 307/41
2012/0200229 A1* 8/2012 Kunst ..... H05B 33/0815 315/186
2015/0351187 A1* 12/2015 McBryde ..... H05B 33/0803 315/185 R
2016/0323972 A1* 11/2016 Bora ..... H05B 33/0842
2018/0041681 A1* 2/2018 Pope ..... H04N 5/2351
2019/0140802 A1* 5/2019 Seo ..... H04J 11/005

* cited by examiner

*Primary Examiner* — Crystal L Hammond
(74) *Attorney, Agent, or Firm* — Clifford H. Kraft

(57) ABSTRACT

A system and method for controlling a multiplicity of luminaries connected to a single wire pair. The luminaries contain minimum circuitry to allow dimming and color tuning by pulses on the wire pair without the need for a separate control wire or control communication bus or network. A single luminary can be color tuned to many different colors as well as dimmed and turned on and off. A driver module drives the wire pair and receives commands over a network The driver module contains a pulse generation circuit that generates and applies pulses to the two-wire output. The amplitude of some the pulses control color of the luminary by selecting different LEDs in the luminary to light, while other pulses control brightness.

15 Claims, 3 Drawing Sheets

MULTIPLEXED VOLTAGE TIME LINE AS GENERATED AND TRANSMITTED BY LED DRIVER

SYSTEM AND METHOD OF TWO-WIRE CONTROL OF MULTIPLE LUMINARIES

BACKGROUND

Field of the Invention

The present invention relates generally to the control and color tuning of luminaries and more particularly to a system and method that controls and color tunes multiple luminaries on a 2-wire circuit.

Description of the Problem Solved

During the past few years, there have been different methodologies developed to control light fixtures. Many of these have required sophisticated networks of transmitters and receivers. These systems have generally been too costly for residential use.

Recently, systems that transmit power of network cabling have also been developed. One particular system is called "Power Over Ethernet" (POE). These systems apply a power source and supply current to power devices over network data signaling lines. This allows remote powering of both controllers and end devices.

It would be tremendously advantageous to have a system that allowed both light bulb brightness and color temperature to be controlled remotely over two wires. This system should use simple components that keep the cost within bounds. A controller should accept color and brightness commands from a network.

SUMMARY OF THE INVENTION

The present invention relates to a system and method for controlling a multiplicity of light bulbs or luminaries connected to a single wire pair. These can be light fixtures, individual luminaries, strings of luminaries or any other type of lighting. The bulbs contain minimum circuitry to allow dimming and color tuning by pulses on the wire pair without the need for a separate control wire or control communication bus or network. A single bulb can be color tuned to many different colors as well as dimmed and turned on and off. The present invention includes a driver module with a controller that receives commands over a network. The driver module also contains a pulse generation circuit that generates and applies cyclic pulses to the two-wire output. The controller can adjust and control the amplitude of the cyclic pulses dynamically on a pulse by pulse basis. Each luminary has a two-wire input attached to the two-wire output of the driver module. The luminary contains a several LED strings, each with a different color temperature. Each luminary also has a voltage filter associated with each LED string. The voltage filter accepts a particular pulse amplitude window to turn on its associated LED string. The driver selects a particular LED string by supplying a pulse to the voltage filter associated with that LED string where the amplitude falls within the particular pulse amplitude window of the voltage filter. The driver controls average bulb color temperature by selecting different LED strings within the luminary cyclically on a time-percentage basis to produce a desired average bulb color temperature. The cyclic pulses form a pulse train with each cycle typically containing at least a sync pulse and a power pulse. In various embodiments of the invention, color tuning is done with the amplitude of the sync pulse, while brightness is controlled by the amplitude of the power pulse.

DESCRIPTION OF THE FIGURES

Attention is now directed to several drawings that illustrate features of the present invention.

Several figures and illustrations have been provided to aid in understanding the present invention. The scope of the present invention is not limited to what is shown in the figures.

DESCRIPTION OF THE PREFERRED EMBODIMENTS

The present invention relates to a system and method that achieves full control of power and light color while keeping the component count down and the cost low. The invention includes a local driver powered by a local voltage or powered over a network with a system such as POE. It also includes a multiplicity of luminaries connected to the driver using only a single wire pair.

Figure 1:
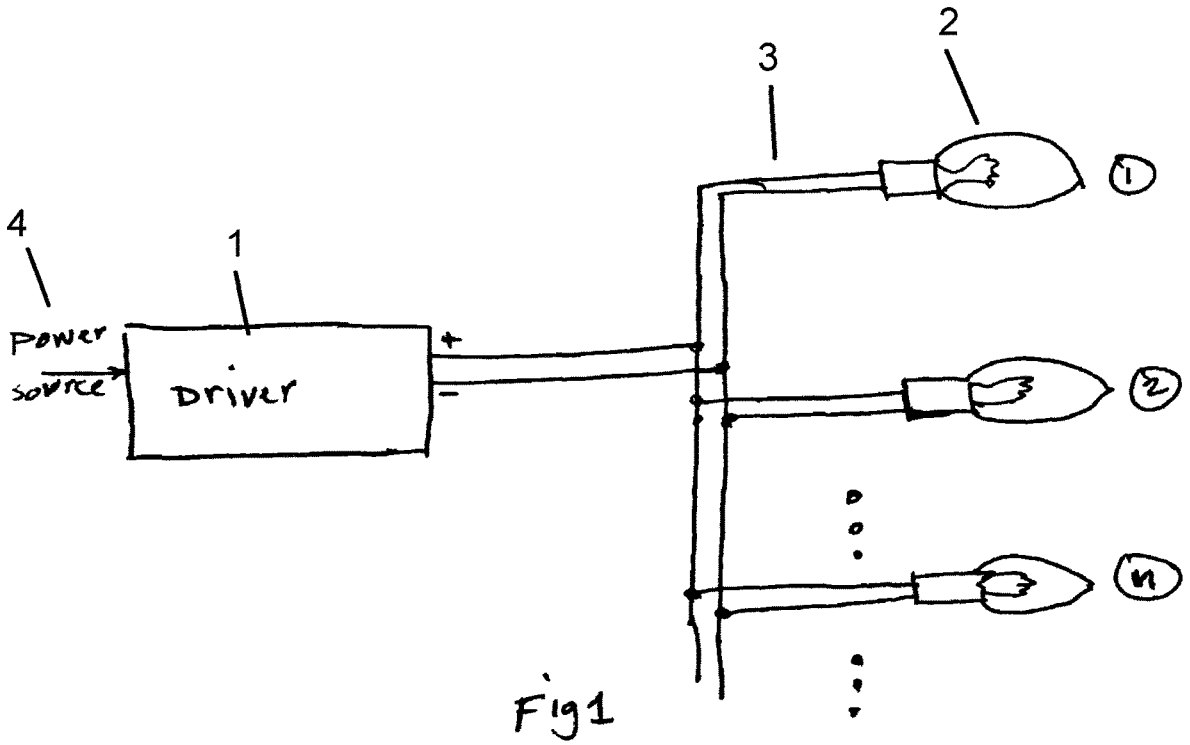
FIG. 1 shows a 2-wire system with a driver controlling multiple light bulbs.

FIG. 1 shows a power supply 4 that supplies power into a driver module 1. This driver 1 is typically in the vicinity of the light fixture or multiplicity of bulbs 2. As can be seen in FIG. 1, several to many bulbs 2 are each tied to a single wire pair 3. FIG. 1 also shows a network connection. This may be a wireless interface, or it may be a wired network such as Ethernet™ or other wired service. In the case of POE, the power for the bulbs 2 can come from the network itself. In some cases, the driver module logic is powered from the data network with POE or the equivalent, while bulb power comes from a single separate power source near the driver. In this case, the separate power source may be standard building AC that is converted to DC by a power supply section or separate supply.

The driver 1 in the embodiment of FIG. 1 has a single output port that supplies DC current to a group of bulbs 2. In other embodiments, the driver 1 may have multiple 2-wire output ports to control different groups of bulbs separately. Data commands enter the driver 1 from the network to cause bulbs to turn off and on, change brightness and to change or tune color.

Figure 2:
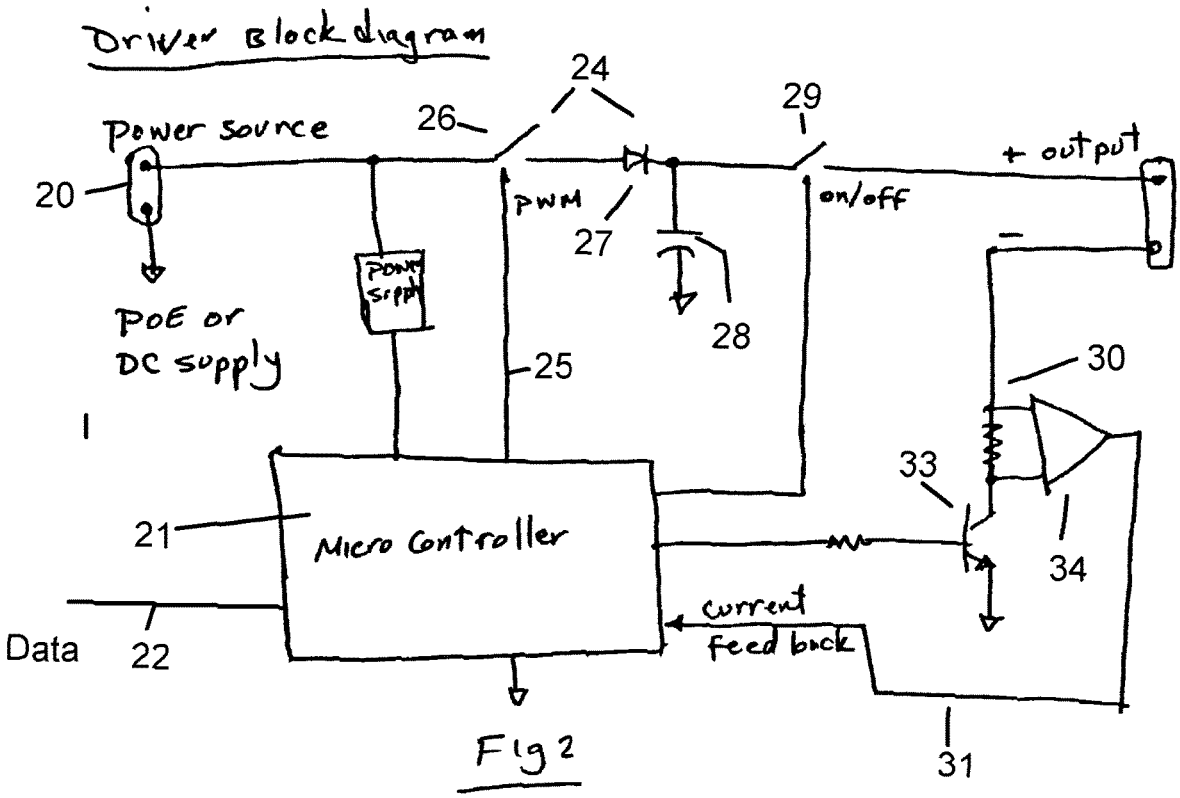
FIG. 2 shows a diagram of an embodiment of a controller.

FIG. 2 shows a schematic/block diagram of a driver such as the driver 1 shown in FIG. 1. The driver has a power source 20 that provides power both for a controller 21 and for the bulbs. The controller 21 can be a micro-controller, a micro-processor or any other type of control circuitry including direct wired logic. The preferred method is that the controller 21 be a micro-controller known in the art. The controller 21 has a data input port 22 from which it receives commands over a network to turn bulbs on or off, to dim or brighten them, or to color tune them. The data input port 22 can receive and transmit data over the network in known ways ether wirelessly or wired such as by Ethernet™.

In the embodiment of FIG. 2, the power source 20 can be either DC power provided by a power supply (usually run by AC building voltage) or can be a POE from the network. Power from the power source 20 is routed to an internal power supply 23 that provides logic voltage for the controller 21 and any other logic circuitry that might be needed (not shown). Current from the power source 20 is also routed to a Pulse-Width Modulation (PWM) switch 24, or other pulse generator that produces a train of pulses. The pulses can be of different widths and different heights. These pulses generally are grouped into cycles that may include a synchronization pulse as well as a power pulse in each cycle. The pulse train is typically created by a signal 25 from the controller 21. The PWM switch 24 is represented in FIG. 2 by a switch symbol 26, a diode 27 and a capacitor 28. The PWM switch 24 generates pulses that control color and performs the dimming function. This is accomplished in most embodiments by adjusting the height (amplitude) of the power pulse that will be applied to the LEDs. However, it is possible in alternate embodiments to also use variable pulse width to control brightness. The pulse height and hence dimming is controlled by the controller 21 on command over the network.

Current from the PWM switch 24 passes through an off/on switch 29 that is under control of the controller 21 through command over the network. The off/on switch 29 performs the simple function of turning the entire driven system completely off or on.

An optional current control circuit 30 allows the controller 21 to adjust and control the total current with a transistor 33. A monitor circuit 34 monitors the total bulb current and reports that to the controller through a current feedback path 31. Current is actually measured across a resistor 32 that drives an amplifier 35 to produce the current feedback 31.

Figure 3:
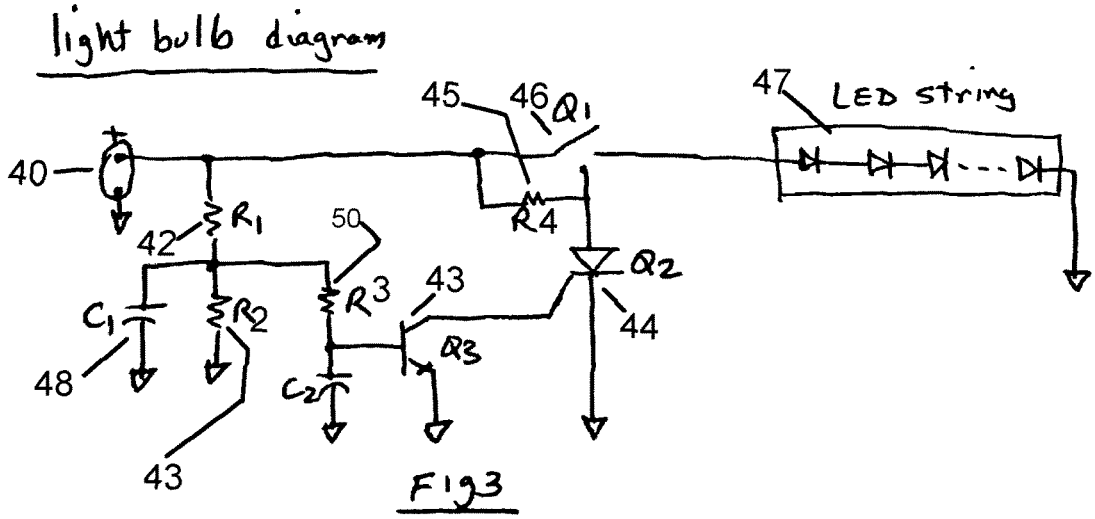
FIG. 3 shows circuitry embedded in a light bulb.

Turning to FIG. 3, part of a circuit that is internal to the light bulb is seen. The circuit represents a voltage filter that only lights the LED string when the PWM voltage pulses are a certain height (voltage). In this manner, different strings having different color temperatures can be selected by the controller simply by varying the amplitude of the pulses.

Voltage pulses enter at the port 40 and enter a voltage divider of two resistors R1 41 and R2 42. This voltage divider drives the base of transistor Q3 43 through a resistor R3 47. A capacitor C2 48 is also connected to the base of Q3 43 to smooth since the input consists of pulses. Resistors R2 42 and R3 47 are typically the same value R. Changing R selects different voltage windows. If the voltage is below the window (too low), switch Q1 46 is open preventing the LEDs from lighting. Also, if the voltage is too low, transistor Q3 43 is off preventing electronic switch Q2 44 from firing. When the voltage is above the window (too high), transistor Q3 43 conducts causing electronic switch Q2 44 to fire effectively shunting incoming current away from the LED string to ground through resistor R4 45. When the pulse height voltage is within a particular range determined by the voltage divider and capacitor, switch Q1 46 is on, and electronic switch Q2 44 is off allowing current to flow through the LED string 47. The circuit depicted in FIG. 3 is thus a voltage filter that only passes current to the LED string 47 when the pulse amplitude is within a certain voltage window. The window voltage is selected by the voltage divider.

A typical bulb can have two or more circuits such as shown in FIG. 3 along with two or more LED strings of different color temperature. Because one of the filters can be chosen simply by the controller 21 in the driver module, the bulb can be color tuned by remote data command over the network to the controller 21 which selects the correct pulse height according to the desired color. Even more important, different individual pulses in the pulse train can dynamically select different LED strings in real time causing usage of multiple strings on a time percentage basis to make fine adjustments in color temperature.

If R2 and R3 are set equal, the following is a sample color selection table:

| |
|---|
| R = 1k ohm - Green |
| R = 2k ohm - Blue |
| R = 3k ohm - Red |
| R = 4k ohm - Warm White |
| R = 5k ohm - Cold White |

The above table is for reference only. The designer can select LED strings with different colors as desired and assign them to different voltage windows. The resistor value R is determined at manufacture time to match a particular voltage filter to a particular LED string within the bulb. It is clear that the circuit can allow N different color values, where N is a positive integer. In the above example, N=5.

A typical embodiment of the present invention is to have two LED strings and two voltage filters present in a single bulb. For example, the first LED string may have a color temperature of 3000 degree white color, while the second LED string may have a color temperature of 5000 degrees. By switching power between these two stings on a percentage basis, the color temperature of the single bulb can be varied over a wide range. In this example, the cycle repetition rate can be around 500 cycles per second (or one power pulse every 2 msec), causing a blend of colors from the two strings. For example, if the 3000 degree string is driven 40% of the time, and the 5000 degree string is driven 60% of the time, the resulting color temperature is 3800 degrees. The human eye performs the integration making the color appear uniform at 3800 degrees. The timing of the signal comes from the controller in the drive module and adjusts the final bulb color to a color that can be commanded over the network from a remote location. As previously stated, the driver and bulbs can be powered over the network using a system like POE, or they can be locally powered.

Figure 4:
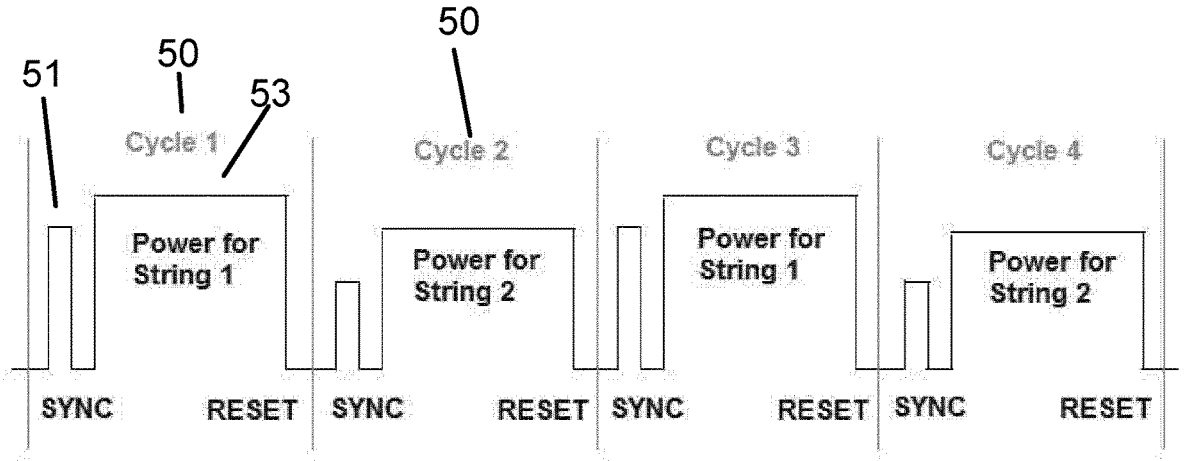
FIG. 4 is a timing diagram of an embodiment of the present invention.

FIG. 4 shows a timing diagram for the above example. Each cycle 50 in FIG. 4 lasts for 2 msec. Each cycle has a short synchronization pulse 51 (sync pulse), and a power delivering pulse 53. Reset periods are quiet intervals between the pulses. Typical values are: cycle time 2 msec, sync time 100 usec, end of power reset time 60 usec. The height of the sync pulse 51 determines which of the two LED strings will light that cycle. The height of the voltage during the power pulse determines the brightness of the lit string. In this embodiment, the voltage windowing is only performed during the sync period. The ratio between the number of cycles allocated to each string controls the final color temperature. The filter assigned to each string charges a capacitor during the sync pulse. Depending upon the value of its associated resistor, the rate of charge of the capacitor produces a set charge voltage. This set charge voltage is typically reset to zero during the last half of the sync signal if the amplitude has not reached a predetermined value (is below the window). At the end of the sync pulse, if the amplitude of the sync was within the chosen voltage window, the transistor for the chosen string turns on lighting its LED string during the power pulse. During the reset time, all transistors are turned off until the next cycle begins. In this embodiment, voltage windowing is performed only on the sync pulse. If the sync pulse is below the voltage window, nothing happens, and if it is above the voltage window, current is shunted around the associated LED string during the power pulse. In either case, the LED string does not light. If a sync pulse has amplitude that falls within the window (determined by resistor R in each filter), current during the power pulse is switched into the associated LED string. The height of the power pulse then determines final LED current and hence brightness. Each cycle can select a different LED string and different brightness.

The above example used only two LED strings; however, it is clear that a single bulb could contain more than two strings. The constraint is available space and cost. It is also clear that different bulbs can be supplied with different color ranges using LEDs of different color and different voltage filters.

It is also clear that the driver module can be wired in parallel to a multiplicity of different luminaries, and that different luminaries can have different selectable color temperatures.

In summary, the present invention allows a local driver module to control a multiplicity of bulbs or luminaries from network commands. The driver can turn bulbs or stings on and off, control brightness, and control color through pulse height. Different LED strings within the same bulb are dynamically selected on a cycle-based system allowing color tuning by selecting a particular LED string for a different percentage of on time.

Several descriptions and illustrations have been presented to aid in understanding the present invention. One with skill in the art will realize that numerous changes and variations may be made without departing from the spirit of the invention. Each of these changes and variations is within the scope of the present invention.

We claim:

1. A system for controlling a plurality of luminaries with a single controller over two wires comprising:

a driver module containing a controller that receives commands over a network;

said driver module also containing a pulse generation circuit that generates and applies cyclic pulses to a two-wire output port, wherein, the controller can adjust the amplitude of said cyclic pulses dynamically on a pulse by pulse basis;

at least one luminary with a two-wire input attached to the two-wire output of the driver module, the luminary containing a plurality of LED strings, each with a different color temperature, and a plurality of voltage filters, wherein each LED string has an associated voltage filter that accepts a particular pulse amplitude window to turn on that LED string;

wherein, the driver selects a particular LED string by supplying a pulse to the voltage filter associated with the particular LED string whose amplitude falls within the particular pulse amplitude window of the voltage filter associated with the particular LED string;

wherein, the driver controls average bulb color temperature by selecting different LED strings within the bulb cyclically on a time-percentage basis to produce a desired average bulb color temperature; and wherein the pulse generation circuit produces a plurality of pulse cycles, each pulse cycle containing a sync pulse followed by a power pulse.

2. The system of claim 1 wherein the amplitude of the sync pulse selects a particular LED string within the bulb.

3. The system of claim 1 wherein, the amplitude of the power pulse controls LED brightness.

4. The system of claim 1 wherein each bulb contains circuitry that is tuned by a resistor value that allows a particular amplitude of the sync pulse to light a selected LED string on the next power pulse by activating the particular voltage filter associated with the selected LED string.

5. The system of claim 4 wherein the amplitude of the next power pulse controls brightness of the associated LED string.

6. The system of claim 1 wherein the two-wire output port is connected in parallel to a plurality of different luminaries.

7. The system of claim 6 wherein commands over the network cause the driver module to light and control different luminaries connected to the two-wire output port.

8. The system of claim 1 wherein each voltage filter has an associated voltage window determined by changing a resistor value.

9. The system of claim 8 wherein each voltage filter can accept one of N different resistor values creating N different possible voltage windows, where N is a positive integer.

10. The system of claim 9 wherein N=5.

11. The system of claim 1 wherein the driver module is powered over the network.

12. A system for controlling a plurality of luminaries with a single controller over two wires comprising:

a driver configured to supply a train of pulses to a luminary, the driver dynamically supplying pulses of different amplitudes to the luminary to control color temperature of the luminary;

the luminary containing circuits that distinguish different pulse amplitudes causing different LEDs to light within the luminary based on pulse amplitude, wherein different LEDs within the luminary have different color temperatures; and wherein the train of pulses is divided into cycles, each cycle containing a sync pulse and a power pulse.

13. The system of claim 12 wherein the amplitude of the sync pulse is used to choose which LEDs light in the luminary, and the amplitude of the power pulse is used to control brightness.

14. The system of claim 12 wherein the driver is connected to a network and receives commands over the network to turn the luminary on and off, to control the color of the luminary and to control the brightness of the luminary.

15. The system of claim 12 wherein the luminary contains a plurality of voltage filters.

* * * * *